US010753653B2

(12) United States Patent
Longsworth

(10) Patent No.: US 10,753,653 B2
(45) Date of Patent: Aug. 25, 2020

(54) HEAT STATION FOR COOLING A CIRCULATING CRYOGEN

(71) Applicant: Sumitomo (SHI) Cryogenics of America, Inc., Allentown, PA (US)

(72) Inventor: Ralph C. Longsworth, Allentown, PA (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 221 days.

(21) Appl. No.: 15/947,003

(22) Filed: Apr. 6, 2018

(65) Prior Publication Data

US 2019/0309994 A1 Oct. 10, 2019

(51) Int. Cl.
*F25B 9/14* (2006.01)
*F28F 3/02* (2006.01)

(52) U.S. Cl.
CPC ..... *F25B 9/14* (2013.01); *F28F 3/025* (2013.01); *F17C 2227/0353* (2013.01); *F25B 2309/001* (2013.01); *F25J 2270/908* (2013.01)

(58) Field of Classification Search
CPC ..... F25B 9/14; F25B 2309/001; F28F 3/025; F17C 2227/0353; F25J 2270/908; F28D 2021/0033
See application file for complete search history.

(56) References Cited

U.S. PATENT DOCUMENTS 3,334,491 A * 8/1967 Cowans ..... F25B 9/14 62/6
3,620,029 A * 11/1971 Longsworth ..... F25B 9/14 62/6
3,673,809 A * 7/1972 Bamberg ..... F02G 1/0445 62/6
3,802,211 A * 4/1974 Bamberg ..... F02G 1/0445 62/6
3,851,173 A * 11/1974 Taylor ..... F25B 9/14 250/332
4,277,949 A 7/1981 Longsworth
4,389,850 A * 6/1983 Sarcia ..... F25B 9/14 137/624.13
4,478,046 A * 10/1984 Saito ..... F25B 9/14 62/402

(Continued)

FOREIGN PATENT DOCUMENTS

FR 2741940 A1 * 6/1997 ..... F25B 9/14
KR 10-2013-0041395 A 4/2013

OTHER PUBLICATIONS

International Search Report and Written Opinion of the International Searching Authority dated Nov. 5, 2019, from the corresponding International Application No. PCT/US2018/026482.

*Primary Examiner* — Ljiljana V. Ciric
(74) *Attorney, Agent, or Firm* — Katten Muchin Rosenman LLP

(57) ABSTRACT

A heat station for a GM or Stirling cycle expander provides heat transfer from a remote load at cryogenic temperatures that is cooled by a circulating cryogen to the gas in a GM or Stirling cycle expander as the cryogen between a regenerator and a displaced volume. The heat exchanger includes a shell that has external and internal fins thermally connected to the shell that are aligned parallel to the axis of the shell and enclosed in a housing having an inlet port and an outlet port on the bottom of the housing.

12 Claims, 5 Drawing Sheets

(56) References Cited

U.S. PATENT DOCUMENTS 4,792,346 A * 12/1988 Sarcia ..... F02G 1/0435 60/520
4,796,430 A * 1/1989 Malaker ..... F02G 1/043 62/6
4,912,932 A * 4/1990 Malaker ..... F02G 1/05 62/196.1
5,088,289 A * 2/1992 Mita ..... F25B 9/14 60/520
5,092,119 A * 3/1992 Sarcia ..... F25B 9/14 60/520
5,447,034 A * 9/1995 Kuriyama ..... F16J 9/06 148/301
5,542,254 A * 8/1996 Pruitt ..... F25B 9/14 62/295
5,647,217 A * 7/1997 Penswick ..... F25B 9/14 60/520
5,735,127 A * 4/1998 Pfotenhauer ..... F25B 9/14 165/4
5,743,091 A * 4/1998 Penswick ..... F02G 1/043 60/517
6,070,414 A * 6/2000 Ross ..... G01J 5/061 62/51.1
6,141,971 A * 11/2000 Hanes ..... F25B 9/14 310/15
6,256,997 B1 7/2001 Longsworth
6,311,491 B1 * 11/2001 Conrad ..... F02G 1/0435 60/520
6,327,862 B1 * 12/2001 Hanes ..... F25B 9/14 62/51.2
6,546,738 B2 * 4/2003 Sekiya ..... F02G 1/043 60/520
8,375,742 B2 2/2013 Wang
8,448,461 B2 5/2013 Longsworth
8,959,929 B2 * 2/2015 Nun ..... F25B 9/14 62/6
10,520,226 B2 * 12/2019 Morie ..... H02K 7/116
10,634,393 B2 * 4/2020 Longsworth ..... F25B 9/14
2002/0088237 A1 * 7/2002 Rudick ..... F25D 23/006 62/6
2002/0134088 A1 * 9/2002 Rudick ..... F28D 15/0266 62/6
2003/0019217 A1 * 1/2003 Sekiya ..... F25B 9/14 62/6
2003/0192324 A1 * 10/2003 Smith ..... F03G 7/002 62/6
2004/0026067 A1 2/2004 Mochizuki et al.
2004/0189105 A1 * 9/2004 Maezawa ..... H02K 33/16 310/36
2005/0120721 A1 * 6/2005 O'Baid ..... F25B 9/14 62/6
2005/0166604 A1 * 8/2005 Park ..... F25B 9/14 62/6
2006/0137339 A1 * 6/2006 Sakamoto ..... F02G 1/053 60/520
2007/0227159 A1 * 10/2007 Murayama ..... C09K 5/04 62/6
2008/0101965 A1 * 5/2008 Zhang ..... F04B 43/04 417/413.2
2008/0276626 A1 * 11/2008 Xu ..... F25B 9/145 62/6
2009/0079276 A1 * 3/2009 Ueda ..... F25B 9/14 310/28
2009/0193805 A1 * 8/2009 Berchowitz ..... H02K 33/16 60/520
2010/0229572 A1 * 9/2010 Raiju ..... F25B 9/14 62/6
2011/0011079 A1 * 1/2011 Kamen ..... F02F 3/0023 60/520
2011/0126553 A1 * 6/2011 Ball-DiFazio ..... F04B 53/08 62/6
2011/0126554 A1 * 6/2011 Morris ..... F25B 9/10 62/6
2011/0219810 A1 * 9/2011 Longsworth ..... F25B 9/14 62/474
2012/0285181 A1 * 11/2012 Dunn ..... F25B 9/06 62/6
2012/0304668 A1 * 12/2012 Xu ..... F25B 9/145 62/6
2013/0074522 A1 * 3/2013 Xu ..... F25B 9/14 62/6
2013/0327065 A1 * 12/2013 Xu ..... F25B 9/00 62/6
2014/0013775 A1 * 1/2014 Koizumi ..... F25B 9/14 62/6
2014/0020407 A1 * 1/2014 Xu ..... F25B 9/14 62/6
2014/0208774 A1 * 7/2014 Morie ..... F25B 9/14 62/6
2014/0374054 A1 * 12/2014 Xu ..... F25B 9/14 165/10
2015/0176867 A1 * 6/2015 Longsworth ..... F25B 9/14 62/6
2015/0253042 A1 * 9/2015 Matsui ..... F25B 9/10 62/6
2015/0276273 A1 * 10/2015 Nakano ..... F25B 9/14 62/6
2016/0097567 A1 * 4/2016 Hiratsuka ..... F25B 9/14 62/6
2016/0123631 A1 5/2016 Xu
2016/0216010 A1 * 7/2016 Longsworth ..... F25B 9/10
2016/0223227 A1 * 8/2016 Nakano ..... F02G 1/053
2016/0223228 A1 * 8/2016 Nakano ..... F25B 9/14
2016/0252280 A1 * 9/2016 Suzuki ..... F28D 1/0226 62/6
2017/0045043 A1 * 2/2017 Yatsu ..... F25B 9/10
2018/0023849 A1 * 1/2018 Longsworth ..... F25B 9/14 62/6
2018/0058730 A1 * 3/2018 Le Bordays ..... F25B 9/14
2018/0066878 A1 * 3/2018 Longsworth ..... F25B 9/06
2018/0094837 A1 * 4/2018 Morie ..... H02K 11/01
2019/0011170 A1 * 1/2019 Morie ..... G01R 33/3815
2020/0027633 A1 * 1/2020 Matsumura ..... G01R 33/421

* cited by examiner

FIG 1A
PRIOR ART
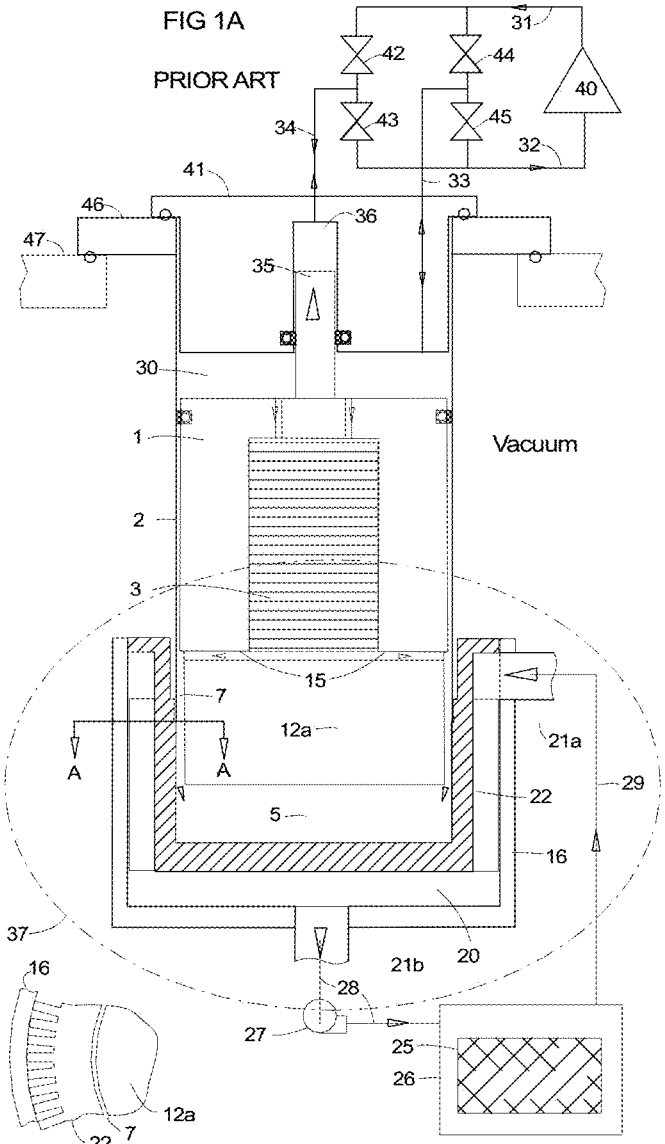
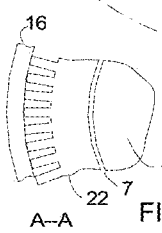
FIG 1B
PRIOR ART
FIG 2
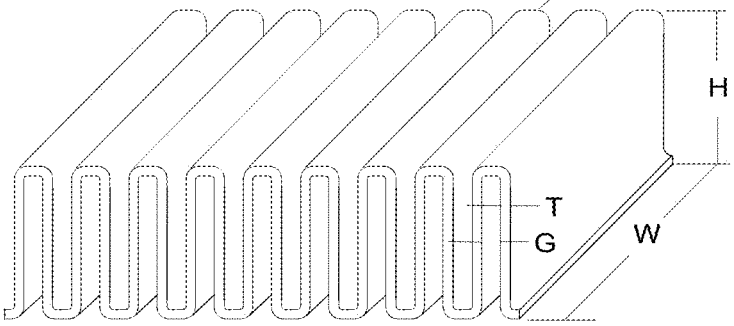

HEAT STATION FOR COOLING A CIRCULATING CRYOGEN

BACKGROUND OF THE INVENTION

1. Field of the Invention

This invention relates to improving the configuration of a heat station that transfers heat from a circulating cryogen cooling an external load to the reciprocating flow of gas internal to the cold end of a high capacity expander operating on the GM or Stirling cycle, producing refrigeration at cryogenic temperatures.

2. Background Information

GM and Stirling cycle refrigerators produce refrigeration at cryogenic temperatures in an expander by flowing gas at a high pressure through a regenerator type heat exchanger to the cold end of a piston reciprocating in a cylinder as the displaced volume is increasing, then lowering the pressure and flowing the gas back through the regenerator as the piston reduces the displaced volume. Refrigeration is made available to cool a load by conduction of heat through the walls of the cold end cap of the cylinder, that encloses the cold displaced volume. The cold end cap and means for transferring heat to the gas in the expander is referred to as the cold heat station.

Most cryogenic refrigerators that are used to cool cryopumps, superconducting MRI magnets, and laboratory research instruments use GM type refrigerators. Most of these applications require relatively small amounts of cooling, 1 to 50 W, at temperatures between 4 and 70 K that is transferred to the refrigerator heat station by conduction. There is now a growing need for refrigerators that can cool loads of 300 to 1,000 W at temperatures near 75 K, which can be cooled most practically by a circulating cryogen. The cryogen can be circulated as a gas by a cold fan or room temperature compressor, as a liquid by a pump, or as a gas or liquid by natural convection. The simplest form of natural convection is to condense a cryogen and have the liquid drain to a load where it evaporates, then returns to the condensing surface as a gas.

It is the object of this invention to provide a high capacity GM expander with a cold heat station that can cool or condense a cryogen, is compact, efficient, and easy to mount and connect to the circulating piping. This requires minimizing the temperature difference between the circulating cryogen and the gas in the expander while minimizing the pressure drop of the circulating cryogen that is flowing through the heat station. Minimizing the pressure drop is important because the power input to a cold fan or pump becomes part of the heat load on the refrigerator. Minimizing the temperature difference involves the design of the internal and external heat exchangers that transfers heat from the circulating gas, through the cold end cap to the internal heat exchanger, which transfers heat to the gas in the expander.

U.S. Pat. No. 4,277,949 to Longsworth shows a system that transfers heat from a remote load using helium that is circulated by a compressor at room temperature cooled by tubes wrapped around the expander heat stations. Loads at different temperatures are connected to the circulating helium by convective couplings which enable the load to be thermally disconnected from the refrigerator. An example of a system that cools a remote load by natural convection of a condensing cryogen is described in U.S. Pat. No. 8,375,742 to Wang. FIG. 7 shows an expander with an extended surface on the cold end mounted in an insulated sleeve. Cryogen condenses on the cold end and drains down through an insulted tube to a dewar (where it could cool a load), and boil-off gas returns up the insulated tube to be recondensed. The option of bringing a small stream of gas to room temperature (to intercept heat leaks) then recondensing it, all by natural convection is also shown.

The heat station of this invention involves the novel combination of several components that enable an advantageous way to mount the expander. The advantageous way to mount the expander requires a compact heat station at the cold end of the expander so that the size of the hole in the mounting plate is minimized and the attachment of the circulating tubes is simplified. Heat exchangers that have been known to be used between the regenerator and expansion space in regenerative expanders include an annular gap, perforated plates, wire screens, corrugated sheet metal, and slots that are cut by wire electric discharge machining (EDM), milling or sawing. Narrow slots that create fins between the slots can be sized to have the best heat transfer relative to pressure drop and void volume.

It is advantageous to form closely spaced fins by using a folded copper ribbon. The ribbon can be formed to have a good balance between the three functional properties, heat transfer, pressure drop, and void volume, at a much lower cost than any of the machining methods. It can even be formed into narrower gaps than can be machined and can be stretched or compressed to change the relationships between the three functional properties.

Folded ribbons can be used to optimize heat transfer in the expander cold end, and more advantageously can be optimized for transferring heat from the circulating flow of cryogen that is bringing heat from a remote load to the outside of the expander cold end. An optimum geometry has been found to be to have an external folded ribbon, that is removing heat from the load, thermally bonded to the outside of a cylindrical cold heat station, and have fins, formed by machined slots or an internal folded ribbon, thermally bonded to the inside of the cold heat station. Heat is thus transferred radially directly from the external folded ribbon on the (copper) heat station shell to the internal fins with a minimal temperature difference. The reason why fins formed by a folded ribbon are more advantageous on the outside of the cold heat station than the inside is because there is no concern for void volume in the external fins thus the surface area and the flow area can be large and the cost advantage is much greater. The folded ribbon requires less material than machined fins and thus is more compact. This arrangement of internal and external heat exchangers enables the diameter of the cold end to be minimized and thus the mounting hole in the vacuum housing can be minimized. A small mounting hole is only possible however if there are no radial fittings on the cold heat station. A novel way of circulating cryogen within the outer housing enables having the tubes that connect to the circulating cryogen mounted on the bottom.

Heat is transferred most efficiently from a load if the circulating cryogen condenses in the external fins and evaporates at the load. Nitrogen can be used to condense and evaporate for loads in the temperature range of about 65 K to 85 K and neon can be used for loads in the temperature range of about 22 K to 35 K. Helium can be used at any temperature within the range of the refrigerators that use helium as a refrigerant.

SUMMARY OF THE INVENTION

The present invention comprises a heat station on a GM expander, for cooling a circulating cryogen, that is compact, efficient, and easy to mount and connect to the circulating piping. The heat station comprises a shell that has external and internal fins thermally connected to it that are aligned parallel to the axis of the shell, in a cylindrical housing that has inlet and outlet ports that connect to the circulating gas piping. The diameter of the housing is minimized by using folded ribbon on the external heat exchanger and locating the inlet and outlet ports on the bottom of the housing so that the diameter of the hole for mounting the expander on the warm flange of the cryostat is minimized. The fins in the external heat exchanger can be configured to allow different circulation patterns in the housing for different cryogens and orientations.

BRIEF DESCRIPTION OF THE DRAWINGS

FIG. 1A shows a schematic of a prior art pneumatically driven GM cycle expander which has an internal cold end heat exchanger like the one described in U.S. Pat. No. 6,256,997. The area that is circled is shown for the new designs shown in FIGS. 3-5.

FIG. 1B illustrates a plan view of a cold end having machined slots which form fins as the external heat exchanger and a partial section of an outer housing.

FIG. 2 shows a section of folded ribbon.

DESCRIPTIONS OF THE PREFERRED EMBODIMENTS

Figure 3A:
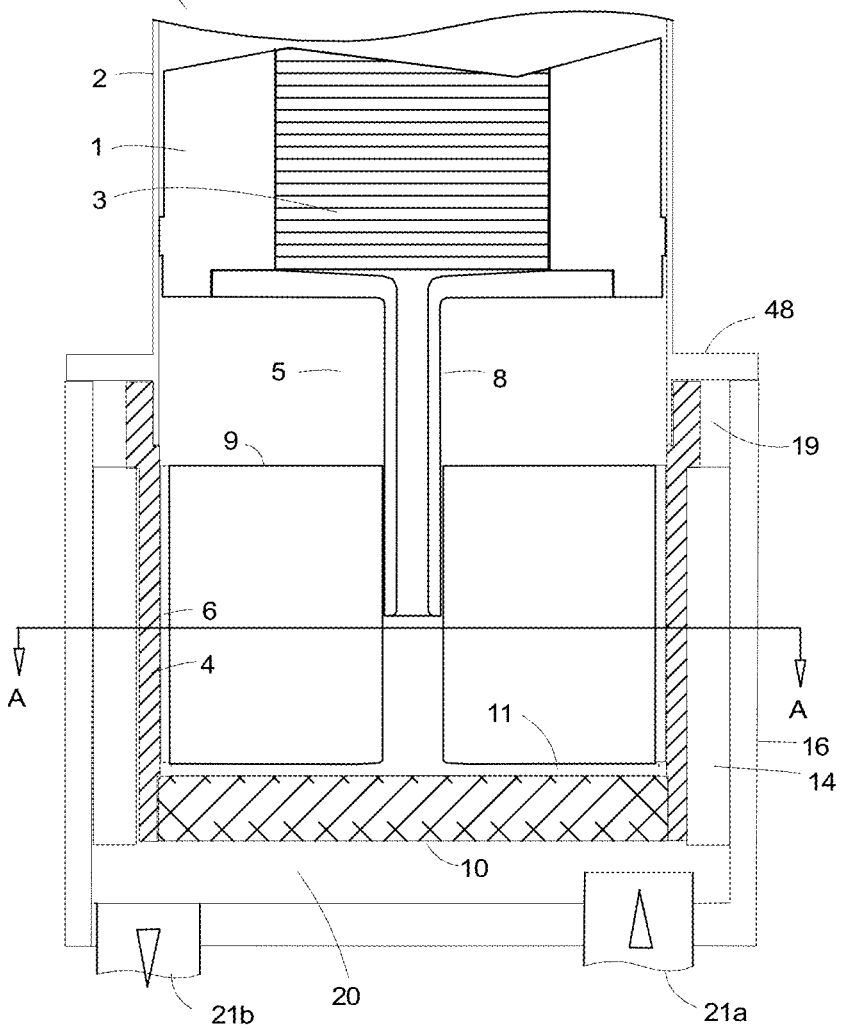
FIG. 3*a* shows a schematic of the cold end of GM expander 100 with a tube that brings gas from the regenerator to the bottom of the cylinder, then back up through an annular space with machined fins inside a circular shell, and into the expansion space. External to the shell is a folded ribbon in a housing designed to recondense a cryogen such as nitrogen.

The drawings use the same number to show the same part, and the words up and top refer towards the warm end while down and bottom refer towards the cold end.

FIG. 1 shows a schematic of a prior art pneumatically driven GM cycle expander which has the cold end heat exchanger design that is most widely used today. The present invention describes new designs for transferring heat from a load to the gas in the expander in the area that is circled at the cold end of the expander. FIG. 1 shows a typical pneumatically driven GM expander in its entirety in order to describe the cycle and put the cold end in context. The system comprises or preferably consists of compressor 40 which supplies gas at a high pressure through line 31 to the expander which admits the gas through warm inlet valve 44 to warm displaced volume 30, then into regenerator 3 in displacer 1, through the regenerator and into expansion space 5 at the cold end of displacer extension 12*a*. Displacer 1 moves up inside cylinder 2 filling displaced volume 5 with cold gas at high pressure. Inlet valve 44 is then closed and outlet valve 45 is opened causing the gas in displaced volume 5 to drop to a lower temperature as it drops to low pressure. The cold gas at low pressure is pushed out of cold displaced volume 5 as displacer 1 moves down. Heat from a load that is connected to cold end 37 is transferred to the cold gas as it flows through annular gap 7, between displacer extension 12*a* and cold end 22, and then through radial ports 15, regenerator 3, warm displaced volume 30, outlet valve 45, and low pressure line 32 to compressor 40. Cylinder 2 has a warm cylinder flange 46 which mounts on cryostat flange 47. Displacer 1 has drive stem 35 attached to the top which reciprocates in drive stem bore 36 in warm head 41. Reciprocation of displacer 1 is caused by opening and closing valves 42 and 43 out of phase with valves 44 and 45 thus causing gas to alternate between high and low pressure as it flows through line 34 to drive stem volume 36.

FIG. 1A includes a schematic of a system presently being built that circulates a cryogen to cool a device, 25, in cryostat 26. Cold end 37 has machined slots which form fins as the external heat exchanger on the outside of cold end cap 22, (shown in FIG. 1*b*) and outer housing 16 which has inlet port 21*a* bringing circulating gas in radially above the fins and outlet port 21*b* below the fins on the bottom of outer housing 16. Circulator 27, which may be a fan or a pump, drives a cryogen through connecting tubes 28 and 29, which are vacuum insulated. This cold end is very effective at transferring heat with a low pressure drop but the radial inlet port results in assembly complexity because it has to be added to cold end 37 after the rest of the expander has been inserted through the port in cryostat flange 47. Also the machined fins add to the cost and size. The main advantage of this invention is to minimize the diameter of cold end 37 so that it fits through a port in cryostat flange 47 that is reasonably small and does not require additional assembly work before the piping that connects to the load, is connected to cold end 37.

FIG. 2 shows a section of folded ribbon 13 which is usually formed from a sheet of copper. The shape of the folded ribbon is defined by the thickness T, the width W, the height H, and the gap G. Folded copper ribbons are presently being manufactured using sheets that are thinner and have narrower gaps than can be machined. Sheets with thicknesses in the range of 0.3 to 1.0 mm can be folded to a H/T ratio of about 15 and a G/(G+T) ratio >0.6. The gaps can be further reduced after the sheet is folded by pushing the folds together. They can alternately be increased by stretching the folded ribbon.

Figure 3B:
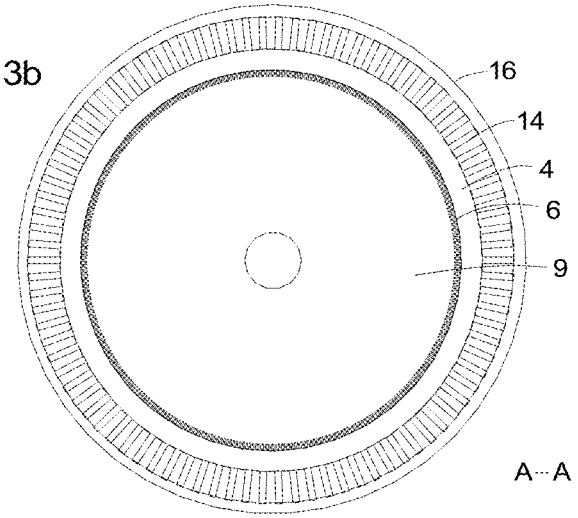
FIG. 3*b* shows an enlarged view of a section of the cold end heat exchanger of GM expander 100 with machined fins internal to the circular shell and folded ribbon fins externally.
Figure 4A:
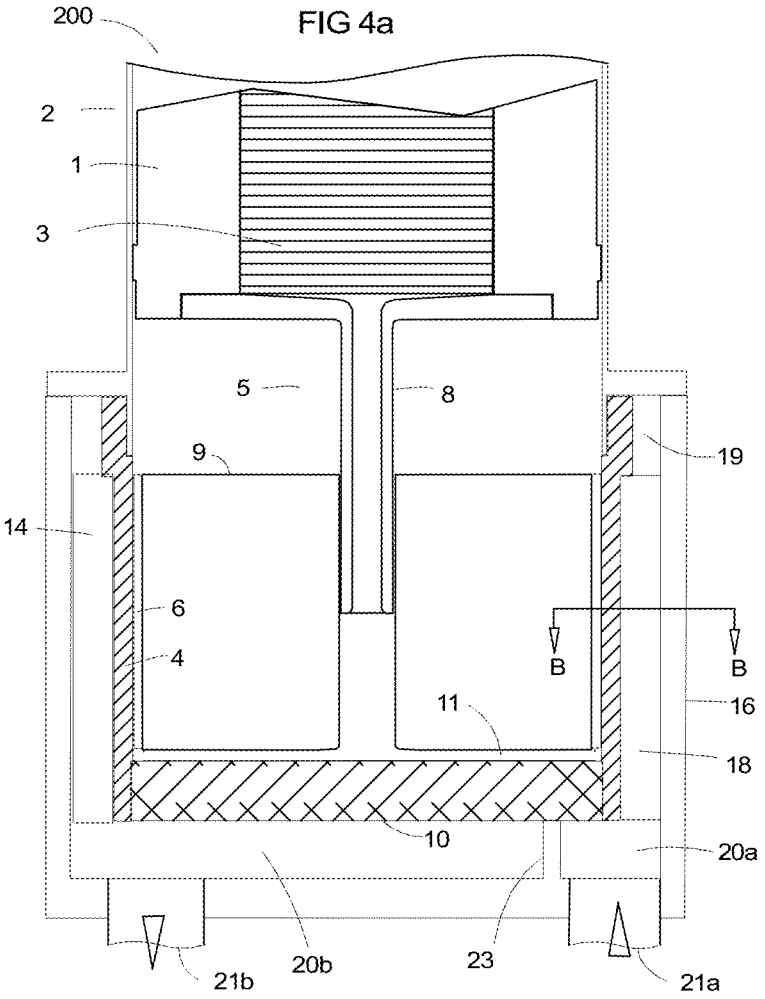
FIG. 4*a* shows a schematic of the cold end of GM expander 200 which has folded ribbon fins in both the internal and external heat exchangers and a housing with two ports. A break in the external folded ribbon allows gas to enter from the bottom then flow to the top where it is distributed to flow back down to the bottom through the fins. This configuration can be used to cool a circulating gas or a condensing cryogen.
Figure 4B:
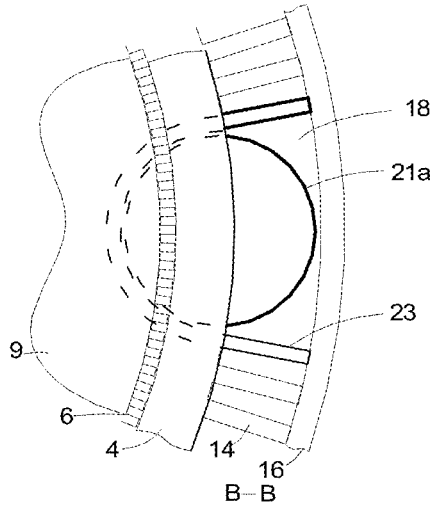
FIG. 4*b* shows an enlarged view of a section of the annular gaps of GM expander 200 with the folded ribbons and the break in the outer folded ribbon where the return gas flows to the top.

The pressure boundary at the cold end of cylinder 2 of expander 100, shown in FIG. 3*a*, is comprised of cylindrical shell 4 and end plate 10. FIG. 3*b* shows details of internal heat exchanger 6, formed by machined slots in core 9, press fit into shell 4, and external heat exchanger 14 comprising a folded ribbon which is thermally bonded to the outside of shell 4. Core 9 has a close enough fit with tube 8 to bring most of the gas from regenerator 3 to the top of end plate 10, then radially through flow channel 11, then back up through internal heat exchanger 6 and into cold displaced volume 5. Housing 16 encloses external folded ribbon 14, has inlet port 21 and outlet port 22 on the bottom, and is mounted to cold flange 48 on cylinder 2. These are arranged so that a cryogen gas, such as nitrogen, can flow through inlet port 21 into manifold 20 which distributes it to folded ribbon 14, where it condenses, then drains as a liquid through outlet port 22 to a load that is being cooled. Manifold 19 above folded ribbon 14 plays a minor roll in distributing gas to the coldest surfaces. Heat flows from the condensing cryogen through external heat exchanger 14, cylindrical shell 4, internal heat exchanger 6, and into gas that is flowing in and out of cold displaced volume 5. The components that are conducting heat, internal and external heat exchangers 6 and 14, and shell 4, are made of materials having high thermal conductivity, copper being preferred, while housing 16 and ports 22 and 21 might preferably be made from SS. While the process of thermally bonding metals having high thermal conductivity usually involves soldering or brazing, it can be done by other means, such as a press fit, as long as the temperature difference across the joint is small relative to the temperature difference between the external and internal gas streams. Not shown is the option of wrapping a heater around housing 16 to facilitate warming the load.

Expander 200, shown in FIG's 4*a* and 4*b*, shows folded ribbon as the internal heat exchanger 14 and is otherwise similar to expander 100 except the external components are designed to cool a circulating gaseous cryogen, rather than condensing a cryogen. This is done by having return port 21*a*, which brings gas that has cooled a load, through the bottom of housing 16, into flow passage 18 which connects to manifold 19 at the top of external folded ribbon 14, and distributes the gas to flow back down through the folded ribbons. Cooled gas then flows out through outlet port 21*b*. Flow passage 18 is separated from outlet manifold 20 by barrier 23.

Figure 5A:
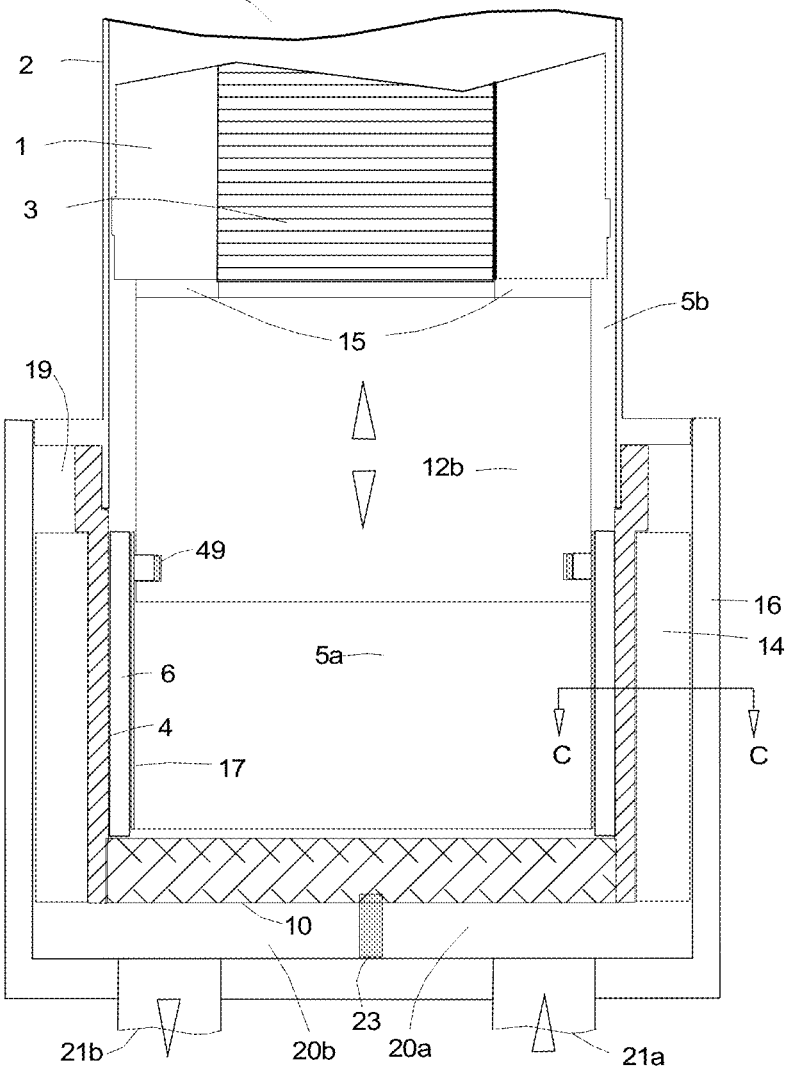
FIG. 5*a* shows a schematic of the cold end of GM expander 300 that has the same inner and outer folded ribbon heat exchangers as GM expander 200 but an extension of the displacer and a seal forces gas from the regenerator to flow down through the inner annular space in the cold end to the expansion space. The housing has a partition across the bottom that causes the gas entering the bottom through a port on one side of the partition to flow up through about half of the external fins and down through the other half, then through the outlet port.
Figure 5B:
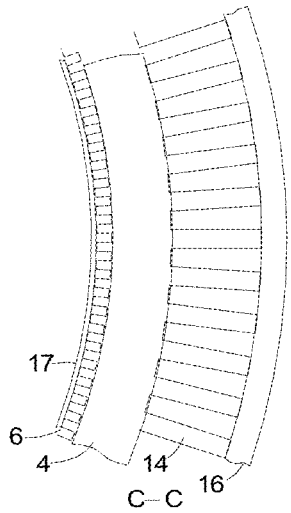
FIG. 5*b* shows an enlarged view of a section of the annular gaps of GM expander 300 with the folded ribbons and the sleeve inside the inner folded ribbon that the seal rides against.

Another means of directing a circulating gaseous cryogen through external heat exchanger 14 is shown in FIG. 5*a* for the cold end of expander 300. Gas flowing through inlet port 21*a* is distributed in lower plenum 20*a* to flow up through the fins on one side of external heat exchanger 14 to the top plenum space 19 and return down through the fins on the other side, the bottom plenum space 20*b*, and the outlet port.

Expander 300 has an extension 12*b* below regenerator 3 that has a close fit inside sleeve 17 which in turn has a close fit inside internal heat exchanger 6. Extension 12*b* has a smaller diameter than displacer 1 and thus divides the cold displaced volume into an inner displaced volume, 5*a*, and an outer displaced volume, 5*b*. Seal 49 prevents gas from leaking between displaced volumes 5*a* and 5*b* and forces gas to flow through radial passages 15 into cold displaced volume 5*b*, where some of it remains, and the balance flows through internal heat exchanger 6 into cold displaced volume 5*a*. Volume 5*b* is approximately 15% of the total cold displaced volume, which means that only about 85% of the gas that would flow through internal heat exchanger 6 in expanders 100 and 200, flows internal heat exchanger 6 in expander 300. This might be thermodynamically advantageous because the last 15% of the gas that flows out of regenerator 3 is significantly warmer than the first 85% so even though less gas flows through internal heat exchanger 6 it is colder on average.

Figure 6:
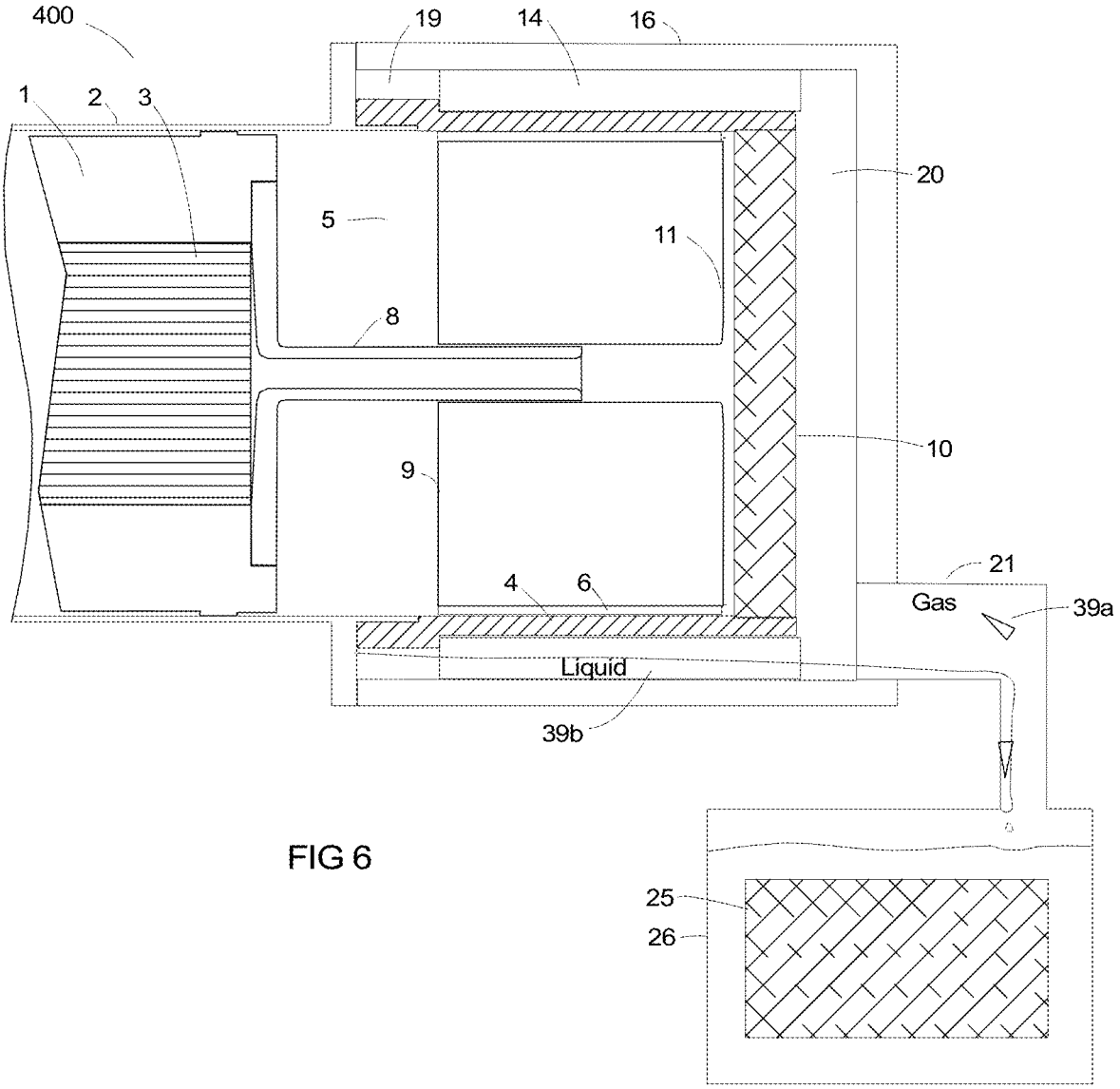
FIG. 6 shows a schematic of the cold end of GM expander 400 with a single port in the end of the housing located such that a cryogen gas that flows into the housing can condense in the external fins and drain out through the port as a liquid when the expander is oriented between cold end down and horizontal.

FIG. 6 shows a schematic of the cold end of expander 400 which has a single port, 21, on the outer bottom of housing 16. Expander 400 can be mounted horizontally such that liquid cryogen 39*b* can drain out through port 21 while gaseous cryogen 39*a* flows in. If the device being cooled is located below port 21 then a cryogen such as nitrogen can circulate by natural convection.

Table 1 has an example that compares an external heat exchanger made by machining fins on the outside of shell 4 with a folded ribbon. The design is based on transferring 400 W of cooling at 80 K by circulating 5 g/s of helium at 200 kPa in which both designs have the same temperature differences, in the gas and the fins, and the same pressure drop. The thickness of the machined fin is at its root and the weight of copper for the machined fin includes the material removed from the groove.

TABLE 1

Comparison of Machined Fins with Folded Ribbon Fins

| | Machined | Ribbon |
|---|---|---|
| Outside Dia. of Shell 4 - mm | 115 | 115 |
| Inside Dia. of Housing 16 - mm | 140 | 131 |
| Width of Fin, W - mm | 100 | 100 |
| Gap, G - mm | 1.0 | 0.8 |
| Thickness, T - mm | 2.0 | 0.5 |
| Number of Gaps | 120 | 310 |
| Weight of Cu to form fins - kg | 4.0 | 1.0 |

The folded ribbon is seen to provide a significant reduction in the diameter of housing 16 and the amount of material needed to make the fins.

In the claims top and bottom, and up and down, refer to the expander when the axis is vertical with the cold end down.

What is claimed is:

1. The cryogenic expander operating on the GM or Stirling cycle cooling a circulating cryogen comprising:

a cylinder having a mounting flange at the warm end;

a displacer, in said cylinder, reciprocating between a warm end and a cold end, a motion of the displacer creating a cold displaced volume;

a regenerator through which a first gas flows in and out of the cold displaced volume; and a first heat exchanger that transfers heat radially through a cylindrical shell from a second circulating gas in a second heat exchanger, external to said shell, to the first gas, wherein the first gas flows between the regenerator and the cold displaced volume through the first heat exchanger, said second heat exchanger enclosed in a housing having inlet and outlet ports for said second gas, said housing having a top plenum space above, and a bottom plenum space below said second heat exchanger, and said inlet and outlet ports, which direct all of said second circulating gas to flow through said second heat exchanger, are on the bottom of the housing.

2. A cryogenic expander in accordance with claim 1, in which said ports are arranged such that a condensable gas returns through the inlet port and a liquid leaves through the outlet port.

3. A cryogenic expander in accordance with claim 2, in which the expander can be oriented between cold end down and horizontal.

4. A cryogenic expander in accordance with claim 2, in which a liquid pump circulates the circulating cryogen.

5. A cryogenic expander in accordance with claim 2, in which the circulating cryogen circulates by natural convection.

6. A cryogenic expander in accordance with claim 1, in which the second heat exchanger comprises fins that are parallel to the axis of the expander formed by one of machined slots in said cylindrical shell and folded ribbon of copper thermally bonded to the external surface of said cylindrical shell.

7. A cryogenic expander in accordance with claim 6, in which gas flowing through the inlet port flows up through the fins on one side of said second heat exchanger to the top plenum space and returns down through the fins on the other side, the bottom plenum space, and the outlet port.

8. A cryogenic expander in accordance with claim 1, in which gas flowing through the inlet port flows up through a by-pass passage inside said housing to the top plenum space and returns down through said second heat exchanger, the bottom plenum, and the outlet port.

9. A cryogenic expander in accordance with claim 8, in which the circulating cryogen circulates by natural convection.

10. A cryogenic expander in accordance with claim 1, in which said second gas is circulated by one of a fan, a liquid pump, and natural circulation.

11. A cryogenic expander in accordance with claim 1, in which a heater is in thermal contact with said second heat exchanger.

12. A cryogenic expander in accordance with claim 1, in which the cold displaced volume comprises a first volume between the regenerator and the first heat exchanger that is less than 20% of the total.

* * * * *